US006868799B2

(12) United States Patent
Wright

(10) Patent No.: US 6,868,799 B2
(45) Date of Patent: Mar. 22, 2005

(54) RAMP FOR PONTOON BOAT

(76) Inventor: William C. Wright, 6665 Crestwood Peninsula, Flowery Branch, GA (US) 30542

( * ) Notice: Subject to any disclaimer, the term of this patent is extended or adjusted under 35 U.S.C. 154(b) by 0 days.

(21) Appl. No.: 10/431,021

(22) Filed: May 7, 2003

(65) Prior Publication Data

US 2003/0230227 A1 Dec. 18, 2003

Related U.S. Application Data

(60) Provisional application No. 60/388,093, filed on Jun. 12, 2002.

(51) Int. Cl.[7] ..... B63B 17/00
(52) U.S. Cl. ..... 114/343; 114/362
(58) Field of Search ..... 114/343, 362

(56) References Cited

U.S. PATENT DOCUMENTS 2,809,496 A * 10/1957 Geil ..... 405/2
4,846,303 A * 7/1989 Cooper et al. ..... 182/36
4,993,341 A * 2/1991 Merkel ..... 114/61.1
5,085,164 A * 2/1992 Whitton ..... 114/362
5,085,165 A * 2/1992 Reed ..... 114/362
2003/0213072 A1 * 11/2003 Myrick et al. ..... 14/69.5

* cited by examiner

*Primary Examiner*—Sherman Basinger
(74) *Attorney, Agent, or Firm*—Harry I. Leon; Vivian L. Steadman

(57) ABSTRACT

A ramp assembly for a pontoon boat, or the like, on which a boat user can come and go from the pontoon boat without having to get wet. A cylindrical float, rotatably attached to the free end of the ramp, keeps it and at least one user thereon afloat. Moreover, the float acts like a roller during docking, enabling one to move the ramp, in its extended position, up and onto the shore at most beaches. The ramp assembly comprises a support structure attached to the underside of the boat and a ramp including a platform which is slideably connected to the support structure by a shaft. Bearing blocks suspend the shaft and the platform, which is pivotally connected thereto, horizontally between a pair of rails. Riding on elongated bearing surface tracks mounted within the rails, the bearing blocks allow the platform to be easily extended outwardly from the support structure for use or, alternately, retracted into it for storage. The platform can be readily extended or retracted, as needed, manually. A motorized embodiment for control of the platform is also provided.

4 Claims, 6 Drawing Sheets

RAMP FOR PONTOON BOAT

RELATED U.S. APPLICATION DATA

This application claims the benefit of the earlier filing date of a Provisional Application having Ser. No. 60/388,093, filed Jun. 12, 2002.

SUMMARY OF INVENTION

The primary object of the present invention is to provide a floatable ramp for a pontoon boat, or the like, across which a boat user can come and go, without having to get wet.

A further object of this invention is to provide such a ramp which can be used to assist swimmers as they enter or leave the boat.

A further object of this invention is to provide a ramp which, while it is projecting from the boat, can be moved easily up and onto a typical beach, thereby facilitating docking.

A still further object of this invention is to facilitate access to the boat by a handicapped person.

An improved ramp assembly comprises a ramp and a support structure which is attachable, in most instances, to the underside of a pontoon boat. The ramp includes a platform which is slideably connected to the support structure by a shaft. Mounted on the platform, the shaft terminates in bearing blocks which are disposed perpendicularly to its centerline. As the ramp is being extended outwardly from or, alternately, retracted into the support structure, the bearing blocks ride on elongated bearing surface tracks mounted within the support structure.

A cylindrical float, rotatably mounted on the free end of the platform, has sufficient buoyancy to support it, as well as a user, when the ramp is fully extended. The cylindrical float not only keeps the ramp afloat but also acts like a roller during docking, enabling one to move the ramp, in its extended position, up and onto the shore at most beaches.

To store the ramp, one slides it into its retracted position on the underside of the pontoon boat, preferably by pulling a rope or the like attached to the free end of the ramp. From its retracted position, the ramp can then be manually pushed out of the support structure and extended for use.

Alternately, means for automatically extending or retracting the ramp comprises an apparatus with a mechanism similar to that commonly used in garage door openers. The apparatus in this embodiment is preferably driven by a 12 volt d.c. electric motor; and a push button switch is used to control the motor.

BRIEF DESCRIPTION OF THE DRAWINGS

FIG. 9 shows a close up view of a fragmentary portion of the ramp assembly according to FIG. 8, a lever used to engage or, alternately, disengage a pair of worm gears within the apparatus for automatically extending or retracting the ramp being illustrated in two different positions, the lever in one of these positions being shown in dotted lines.

DETAILED DESCRIPTION OF THE PREFERRED EMBODIMENT

Figure 1:
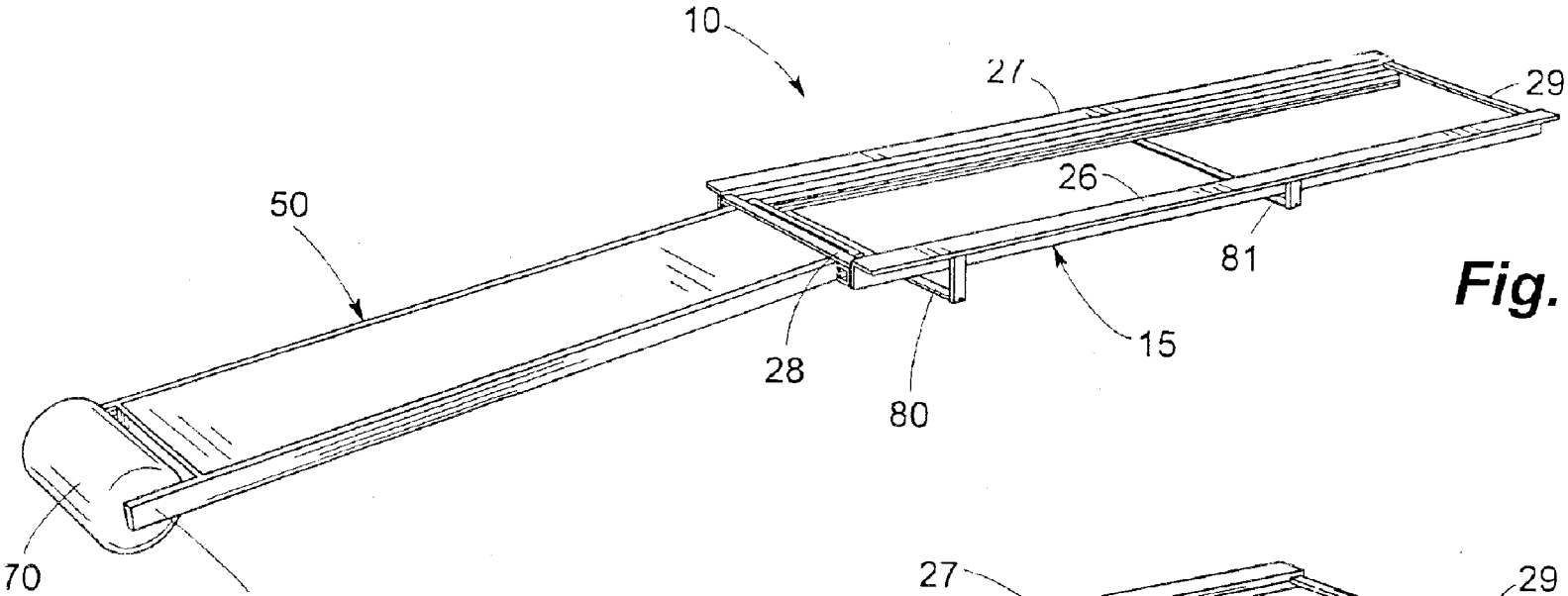
FIGS. 1 and 2 are right side perspective views of the improved ramp assembly with the ramp in its extended and retracted positions, respectively, relative to its support structure.
Figure 2:
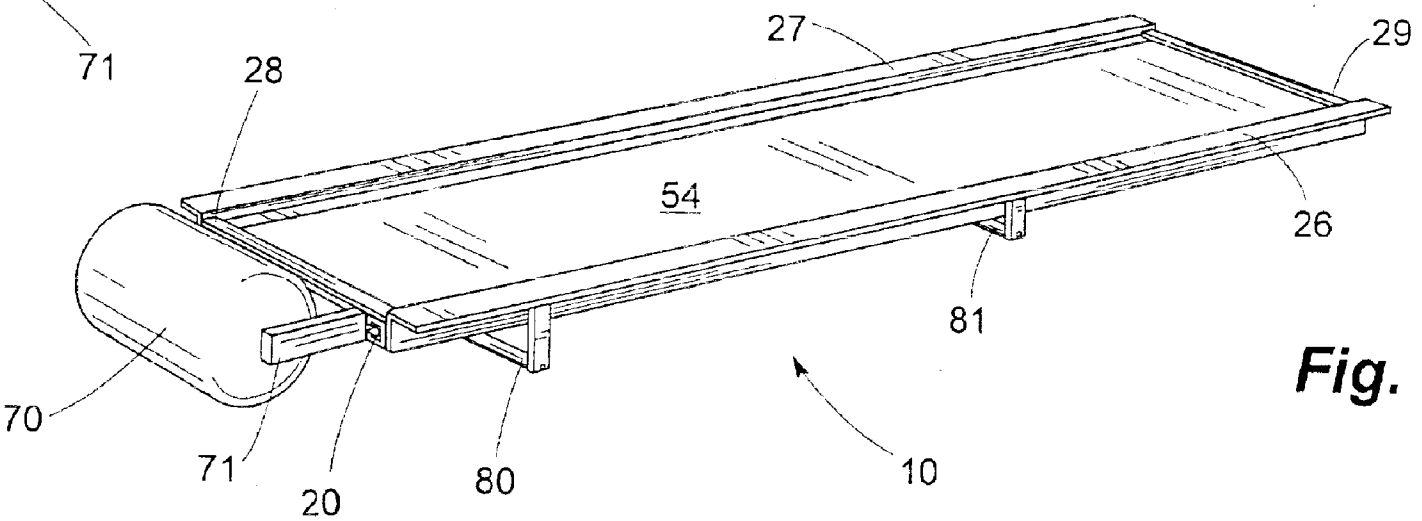
Figure 3:
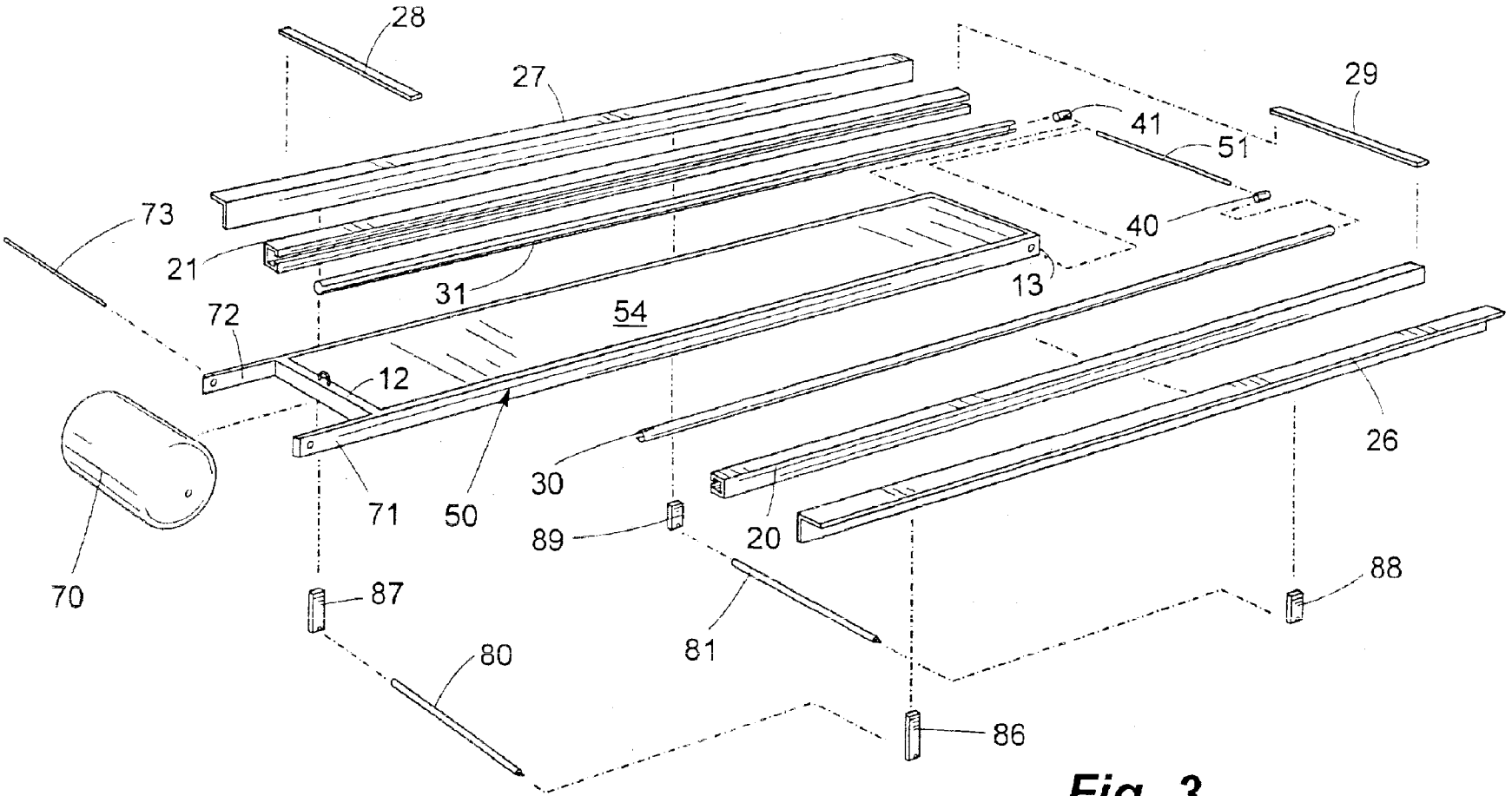
FIG. 3 is an exploded view of the ramp assembly according to FIG. 1, illustrating components of the ramp assembly ready for installation on a typical pontoon boat.
Figure 5:
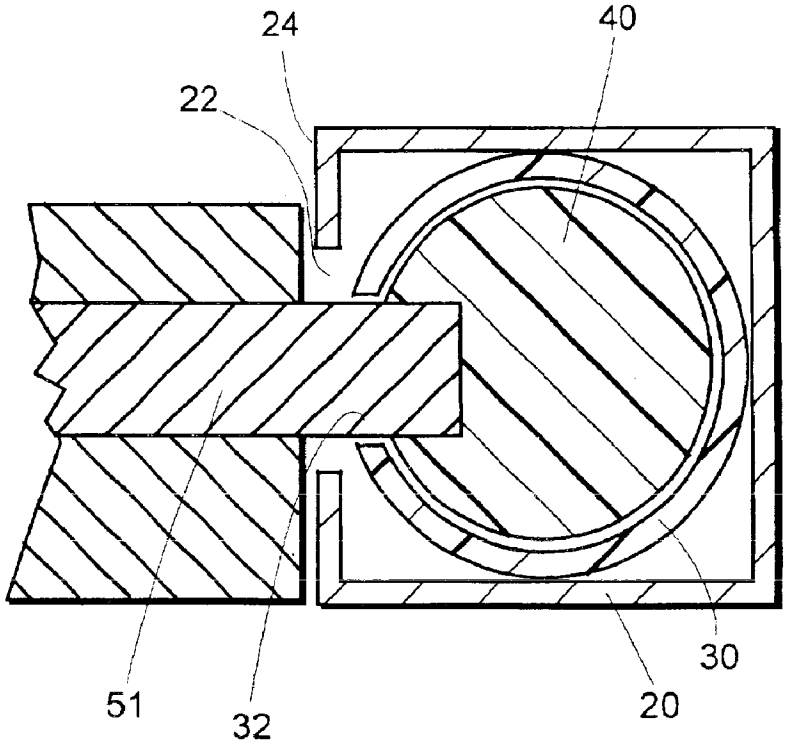
FIG. 5 is a transverse cross-section, on an enlarged scale, of fragmentary portions of the support structure and of the ramp, including a shaft mounted thereon which terminates in a bearing block, the bearing block being slideably received within a bearing surface track mounted within the support structure.
Figure 4:
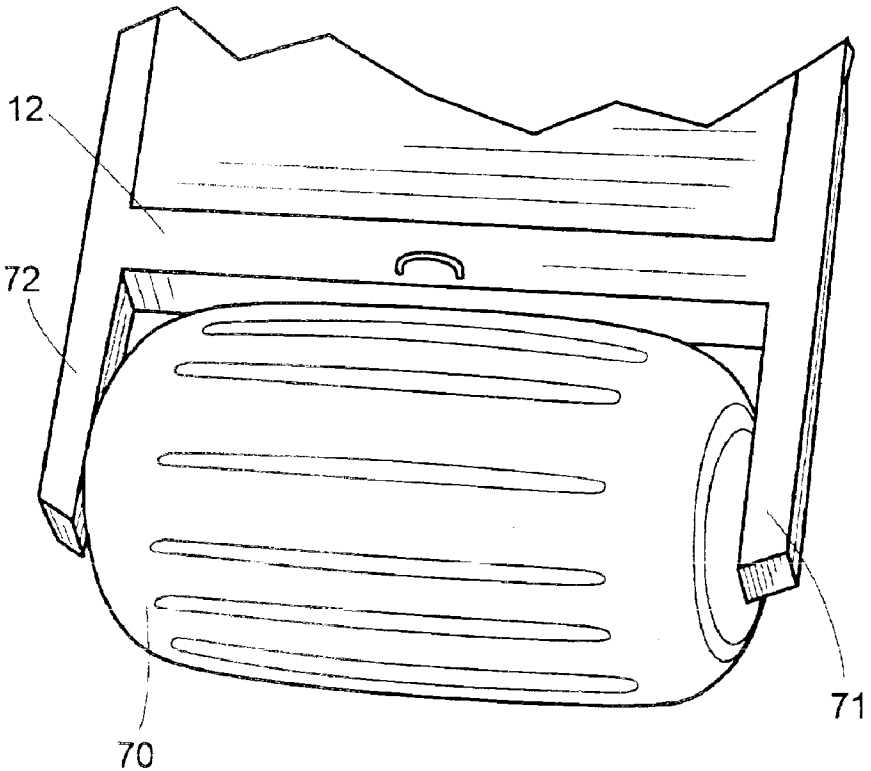
FIG. 4 is a closeup view, on an enlarged scale, of a fragmentary portion of the ramp assembly according to FIG. 1, showing the float and a pair of mounting brackets on the free end of the ramp.

In the drawings, an improved ramp assembly is indicated generally by the reference numeral 10. The ramp assembly 10 comprises a support structure 15 and a platform 50 (FIGS. 1–3). Distal ends of the platform 50 are supported by a shaft 51 and a float 70, which is rotatably mounted on an axle 73. The axle 73 is held in place by a pair of brackets 71, 72 (FIG. 3). Bearing blocks 40, 41, which are mounted perpendicularly to the shaft 51, suspend it and the platform 50, which is pivotally connected thereto, horizontally between rails 20, 21 (FIGS. 3 and 5). The rails 20, 21, together with angle members 26, 27 and cross members 28, 29, comprise the support structure 15 (FIGS. 1 and 3).

Preferably fabricated from square channel tubing, the rail 20 includes a wall 24 with an elongated slot 22 (FIG. 5). In the support structure 15, the slot 22 is aligned generally parallel with a similar elongated slot in the rail 21 (FIG. 3).

Mounted within each rail 20, 21, an elongated bearing surface track 30 defines a slit 32 which preferably extends the length of the track (FIGS. 3 and 5). As illustrated in FIG. 5, the slit 32 faces inwardly towards the contiguous slot 22 in the rail 20. Likewise, both the slit 32 and the elongated slot in the rail 21 are contiguous and face inwardly (FIG. 3).

Figure 6:
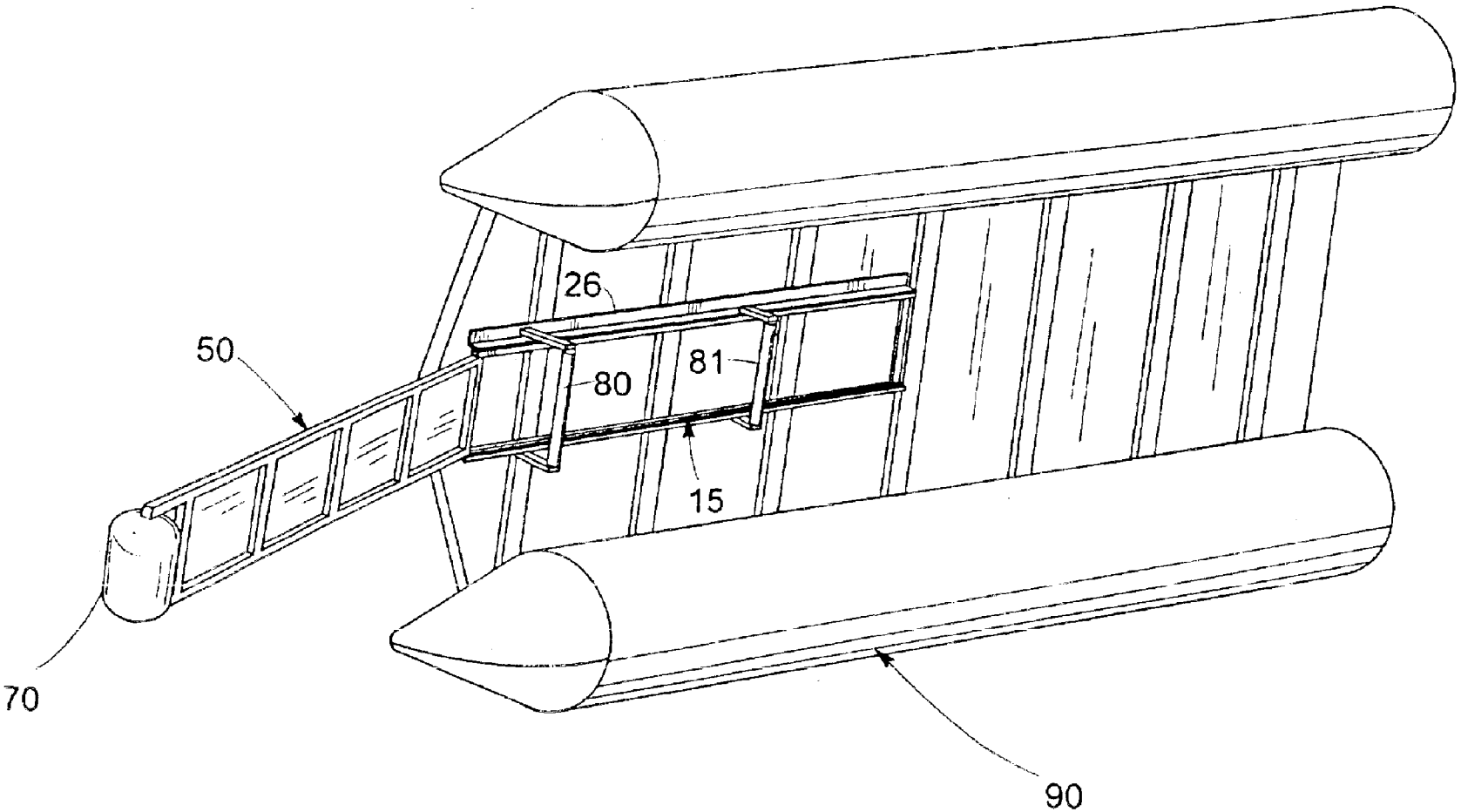
FIG. 6 is a perspective view of the underside of a pontoon boat on which the ramp assembly according FIG. 1 has been installed, the ramp being shown in a fully extended position, the pontoon boat forming no part of the invention.
Figures 7A, 7B:
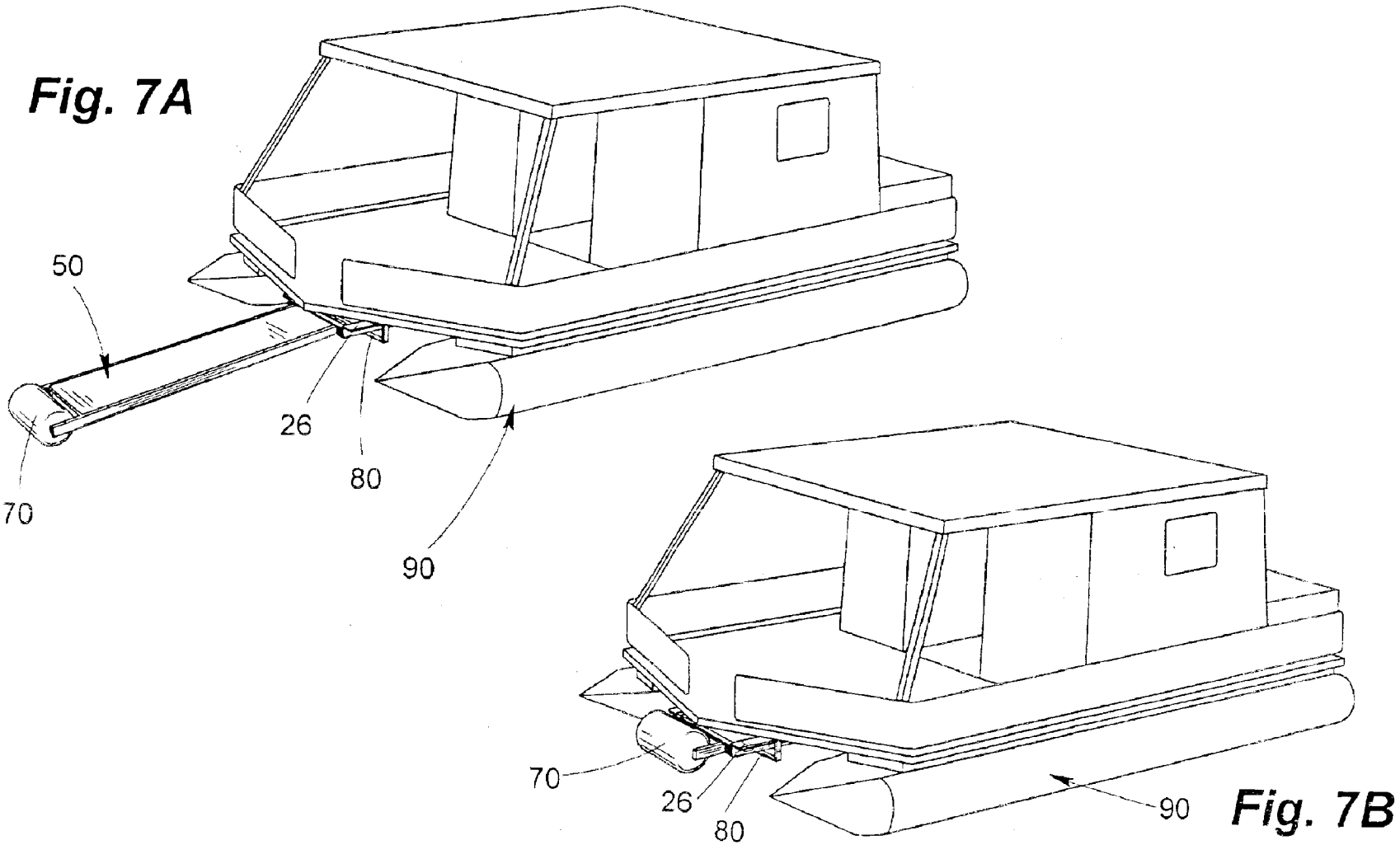
FIGS. 7A and 7B are perspective views of the topside of a pontoon boat on which the ramp assembly according FIG. 1 has been installed, the ramp being shown in extended and retracted positions in FIGS. 7A and 7B, respectively.

In use, the bearing blocks 40, 41 slideably ride within the bearing surface tracks 30, 31, respectively (FIGS. 3 and 5). As one moves the platform 50 into its extended position, the bearing blocks 40, 41 slide rearward—relative to the front end of pontoon boat 90—within the elongated bearing surface tracks 30, 31 (FIGS. 3, 6 and 7A). Alternately, when the platform 50 is being retracted, the blocks 40, 41 slide forward.

In the platform 50, elongated side members, of which the brackets 71, 72 are forward extensions, and cross members 12, 13 comprise a generally rectangular frame to which sheet metal or the like is attached (FIGS. 1–3). The sheet metal is preferably covered with an exterior carpet 54 for extra safety.

Fitted between the brackets 71, 72, the cylindrical float 70 preferably has sufficient buoyancy to keep the aft end of the platform 50 above the water surface even when a user is standing on the platform. Easily rotatable about the axle 73, the float 70 also acts as a wheel for helping a user dock the platform 50 on a beach.

Means for stabilizing the platform 50 as it is being extended or retracted includes a pair of guides 80, 81 which are rotatably connected to vertical supports 86, 87; 88, 89, respectively (FIG. 3). The guides 80, 81 also support the free end of the platform 50 when the pontoon boat 90 is in dry dock. Vertical supports 86, 88; 87, 89 themselves are rigidly attached to angle members 26, 27 from which they extend downwardly (FIG. 3).

The platform 50 can be extended by manually pushing its free end away from the support structure 15. Alternately, the platform 50 can be retracted by pulling its free end back with a rope (not shown) preferably attached to the cross member 12.

In the prototype, the rails 20, 21 were fabricated from a pair of 2 inch square aluminum channels, each of which measures 8 feet long and has a wall thickness of ¼ inch. The elongated bearing tracks 30, 31 were made from Schedule 40, 1½ inch O.D. PVC pipe. Generally cylindrical in shape and sized so that they can be slideably fitted within the elongated bearing tracks 30, 31, bearing blocks 40, 41 measure, by way of example, 1 inch in diameter and 2 inches in length. In this configuration, friction between the bearing blocks 40, 41 and the bearing surface tracks 30, 31 is sufficiently low that retracting the platform 50 requires one to exert a force of only about 10 pounds.

The platform 50 in the same prototype includes a frame fabricated from 1 inch square channel aluminum tubing and an ⅛ inch thick aluminum sheet. The latter is attached to and covers an approximately 2 foot by 8 foot section of the frame. Alternately, a platform fabricated of sheets of aluminum, fiberglass or the like between which is sandwiched a fill material, such as plastic foam, can be utilized.

In the prototype, the float 70 comprises a hollow cylinder, measuring approximately 8 inches in diameter and 20 inches long, which can be inflated for extra rigidity. A suitable float is Model No. 218HTM2W, manufactured by Taylor Made. Other floats which can be used in the ramp assembly 10 include those which have larger hollow cylinders, as well as floats filled with a plastic foam material.

Figure 8:
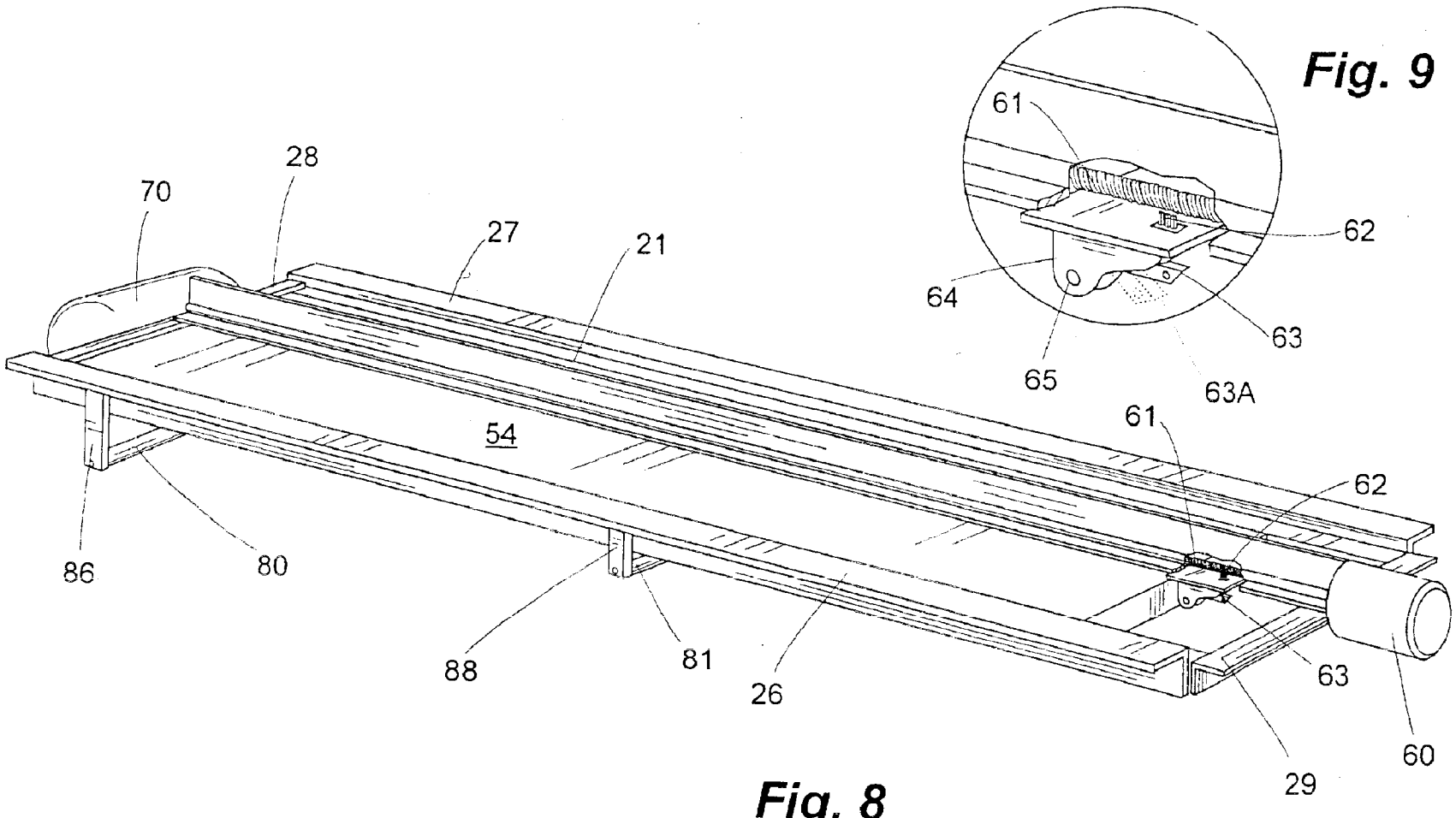
FIG. 8 is a perspective view of an alternate embodiment of the improved ramp assembly according to FIG. 1, which includes an apparatus for automatically extending or retracting the ramp.

In an alternate embodiment, the platform 50 is moved relative to the support structure 15 with the use of an electric motor 60 and a pair of worm gears 61, 62 (FIG. 8). The worm gear 61 is mounted on an elongated frame member which is suspended between and affixed to the two cross members 28, 29 (FIG. 8). The worm gear 62, which protrudes upwardly from an arm 63, engages the worm gear 61 when the arm is in its fully "up" position (FIG. 8). The arm 63 itself is pivotally supported by a pin 65 within a yoke 64 which is affixed to the rear of the platform 50 (FIGS. 8 and 9). The worm gears 61, 62 are disengaged when the arm is in its "down" position 63A (FIG. 9). Suitable controls are provided so that when the gears 61, 62 mesh, the platform 50 can be moved either forward or aft, as desired, by turning on the electric motor 60. In the preferred embodiment, the motor is driven by 12 volt d.c.; but a 110 volt a.c. motor can be used in its stead. When the gears 61, 62 are disengaged, the platform 50 can be moved manually.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A ramp assembly adapted for use with a pontoon boat, which comprises:

(a) a support structure having at least one elongated bearing surface track, the support structure being affixed to the underside of the boat in such a way that, in use, the bearing surface track extends generally horizontally;

(b) an elongated platform;

(c) a shaft to which one end of the platform is pivotally connected; (d) means, including the shaft and at least one bearing block mounted thereon which slides within the bearing surface track, for slideably adjusting horizontal extension of the platform relative to the elongated bearing surface track; and (e) a floatable body mounted on the platform distal from said end, the floatable body having sufficient buoyancy to float itself and the platform when the platform is at its full horizontal extension, the bearing block riding on the bearing surface track throughout the platform's travel as the platform is moved from a position in which it is fully retracted beneath the boat to full horizontal extension.

2. The ramp assembly according to claim 1, wherein the floatable body is generally cylindrical in shape and is rotatably mounted, so that when the platform is extended and the boat is being docked on a beach, the floatable body acts like a roller to facilitate docking.

3. The ramp assembly according to claim 1, which further comprises means for automatically extending the platform outwardly from the support structure; and means for automatically retracting the platform into the support structure.

4. A ramp assembly adapted for use with a pontoon boat, which comprises:

(a) a support structure having at least one elongated bearing surface track, the support structure being affixed to the underside of the boat in such a way that, in use, the bearing surface tract extends generally horizontally;

(b) an elongated platform;

(c) a shaft to which one end of the platform is pivotally connected;

(d) means, including the bearing surface track, the shaft and at least one bearing block mounted thereon which, during use, slides within the bearing surface track at all times, for slideably supporting said end of the platform; and (e) a floatable body mounted on the platform distal from said end, the floatable body having sufficient buoyancy to float itself and the platform when the platform is at its full horizontal extension relative to the bearing surface track, the end of the platform distal from the shaft being movable upwardly and downwardly across a span which increases continuously in height as the platform is moved from a position in which it is retracted over one-half the platform's length beneath the boat to full horizontal extension.

* * * * *